US007551748B2

(12) United States Patent
Kamo et al.

(10) Patent No.: US 7,551,748 B2
(45) Date of Patent: Jun. 23, 2009

(54) EARPHONE

(75) Inventors: Shotaro Kamo, Shizuoka (JP); Eiji Matsuyama, Shizuoka (JP); Hajime Kitamura, Shizuoka (JP); Isao Fushimi, Shizuoka (JP); Masayoshi Sugiyama, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 848 days.

(21) Appl. No.: 11/084,045

(22) Filed: Mar. 21, 2005

(65) Prior Publication Data

US 2005/0226453 A1 Oct. 13, 2005

(30) Foreign Application Priority Data

Mar. 26, 2004 (JP) ..... P2004-091254

(51) Int. Cl.
*H04R 25/00* (2006.01)

(52) U.S. Cl. ..... 381/380; 381/328; 439/459; 439/456

(58) Field of Classification Search ..... 381/380, 381/328, 72; 181/129, 134, 135; 439/456, 439/459

See application file for complete search history.

(56) References Cited

U.S. PATENT DOCUMENTS

| | | | | | |
|---|---|---|---|---|---|
| 2,545,731 | A | * | 3/1951 | French | 181/135 |
| 4,443,668 | A | * | 4/1984 | Warren | 455/351 |
| 5,145,402 | A | * | 9/1992 | Plyler et al. | 439/459 |
| 5,949,896 | A | * | 9/1999 | Nageno et al. | 381/328 |
| RE38,351 | E | * | 12/2003 | Iseberg et al. | 381/380 |
| 2006/0140434 | A1 | * | 6/2006 | Yang | 381/380 |

FOREIGN PATENT DOCUMENTS

| | | | |
|---|---|---|---|
| JP | 61-48661 | U | 4/1986 |
| JP | 2003-143681 | A | 5/2003 |
| JP | 2003-143682 | A | 5/2003 |

* cited by examiner

*Primary Examiner*—Curtis Kuntz
*Assistant Examiner*—Jasmine Pritchard
(74) *Attorney, Agent, or Firm*—Sughrue Mion, PLLC

(57) ABSTRACT

The receiver unit includes a receiver body, a housing containing this receiver body, a cord connected to the receiver body, and a cord protector for protecting the cord. The cord protector is a plate-like member having a substantially rectangular shape, and includes an engaging portion and a semicircular portion. The cord protector is formed of soft material such as urethane rubber having Shore hardness of about A90, and its wall thickness is set to be 0.3 to 0.6 mm (0.5 mm, for example).

8 Claims, 3 Drawing Sheets

EARPHONE

BACKGROUND OF THE INVENTION

1. Field of the Invention

The present invention relates to an earphone, and more particularly, to a structure of a cable protecting portion of the earphone.

2. Description of the Related Art

Generally, an earphone includes an earphone unit, and a cable for connecting this earphone unit to an external apparatus. An earphone disclosed, for example, in JP-A-2003-143682 has been known as the earphone of this type.

The earphone unit of this earphone includes an ear chip to be inserted into an external auditory canal, and a casing which incorporates a receiver, and further, a cable is extended from a lower part of a backward end of the casing. This casing is formed of resin which has relatively larger hardness than the cable, and provided, in a part thereof, with an insertion hole fromwhichthecable is extended. As for thecable, aflexible cable which is formed of fine copper wires bundled and coated with vinyl or the like is employed.

SUMMARY OF THE INVENTION

However, in case where the cable is extended in this manner, the following problem may occur.

Specifically, in contrast with the soft and flexible cable, the insertion hole is formed of resin which has relatively larger hardness than the cable. For this reason, when the earphone is used by a user, the cable will be crooked in the vicinity of the insertion hole, and accordingly, stress will be concentrated on the copper wires inside the cable. There has been such a problem that when this has happened repeatedly, the copper wires inside the cable may be broken due to the stress.

The invention of this application has been made in view of such circumstances, and it is an object of the invention to provide an earphone in which breakages of copper wires inside a cable can be prevented.

Specifically, according to the invention, there is provided an earphone including: a fitting portion to be fitted to an inlet of an external auditory canal; a casing which supports the fitting portion; and a cable which is extended from the casing to an external apparatus, wherein the casing is provided with a protective member which is arranged along the cable and formed of a plate-like member for preventing a breakage of the cable.

Moreover, the fitting portion is provided forward of the casing in a direction of inserting it into the external auditory canal, the cable is extended from a backward lower part of the casing, at least a part of the casing forward of a position where the cable is extended is covered with an exterior member which is softer in hardness than the casing, the protective member is a plate-like member having elasticity in a back and forth direction of the casing, and attached to a back of the casing and pressed against the cable from backside.

Further, the protective member is formed of resin which is softer in hardness than the casing and harder than a sheath of the cable.

Still further, the protective member has Shore hardness below A100.

As shown in the above described structure, the earphone according to the invention has the protective member for preventing breakages of copper wires inside the cable, and when a user uses the earphone, concentration of stress on the copper wires inside the cable due to crooks of the cable can be prevented, and as a result, breakages of the copper wires can be prevented.

Moreover, in the earphone of the type that the cable is extended from the backward lower part of the casing, due to the fact that the protective member is the plate-like member which is attached from the back of the casing and has the elasticity in the back and forth direction of the casing, repeated crooks of the cable in the vicinity of the insertion hole will be eliminated, and thus, breakages of the copper wires inside the cable can be reliably prevented.

Further, because the protective member is formed of resin which is softer in hardness than the casing and harder than the sheath of the cable, the protective member will not be broken due to friction with the sheath of the cable, and protecting performance can be exerted for a long term.

Particularly, it is desirable that the protective member has Shore hardness below A100, whereby breakages of the copper wires inside the cable can be prevented, and a long life protective member free from a breakage of the protective member can be realized.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Figure 1:
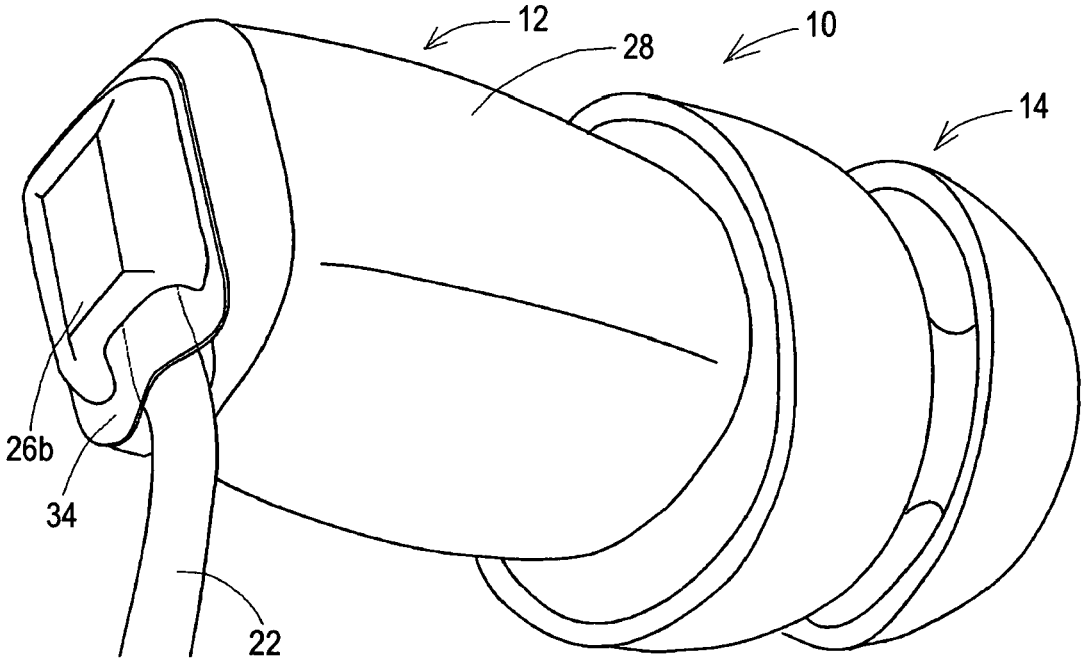
FIG. 1 is a perspective view showing an insertion type earphone according to an embodiment of the invention.

Now, an embodiment of the invention will be described referring to the drawings.

Figure 2:
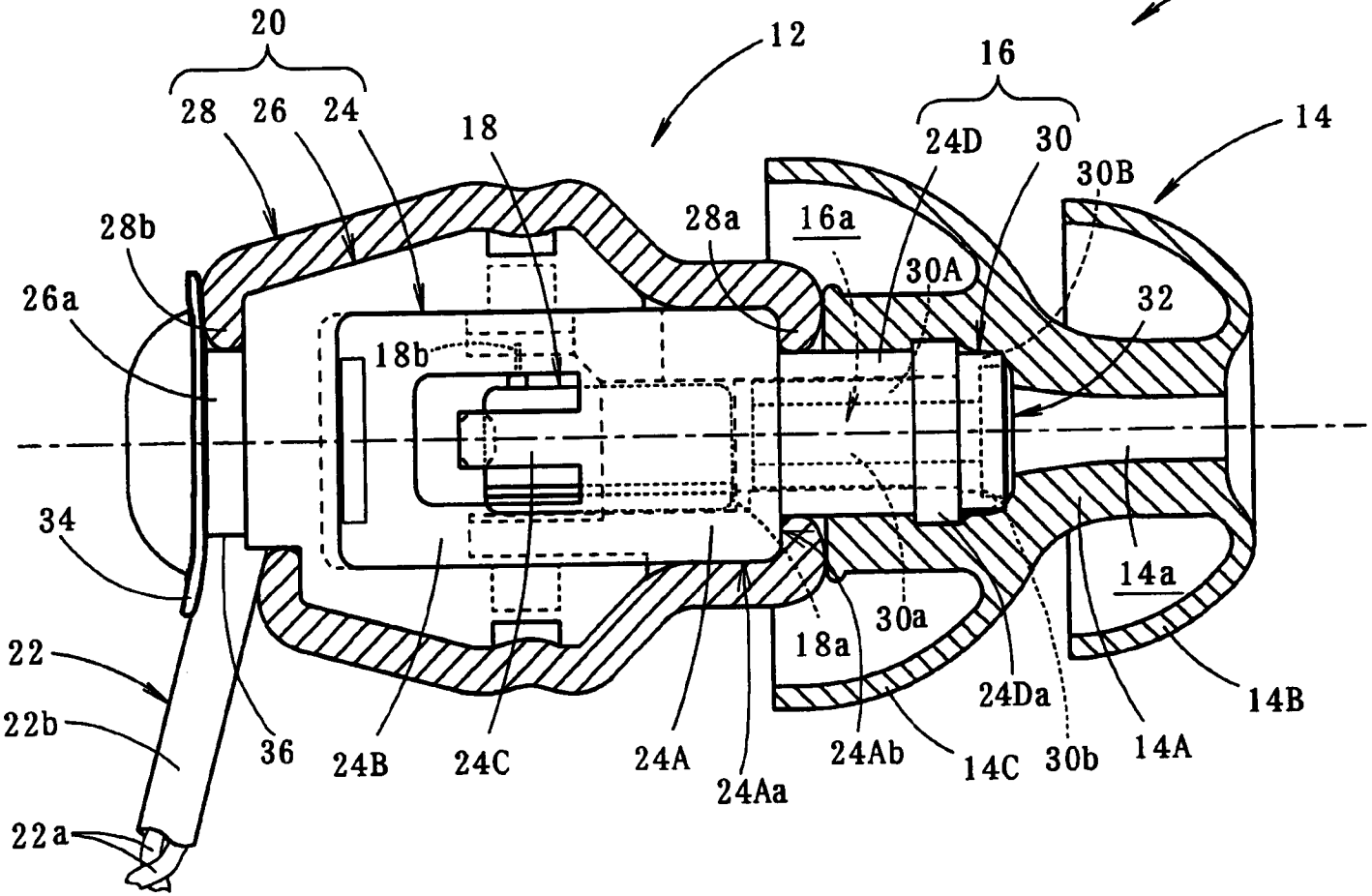
FIG. 2 is a sectional side view showing the insertion type earphone according to the embodiment of the invention.
Figure 3:
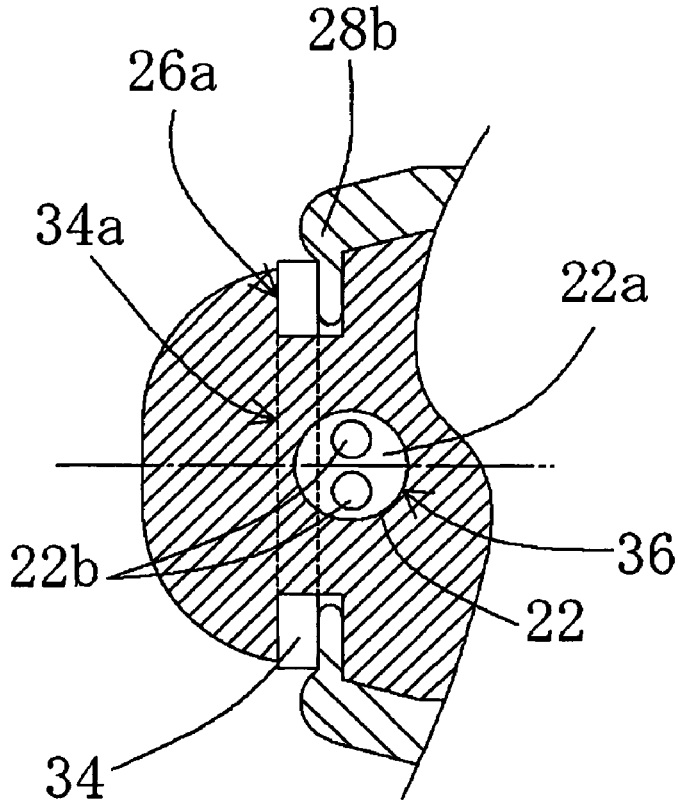
FIG. 3 is a fragmentary sectional view showing a backward end part of the insertion type earphone according to the embodiment of the invention, as seen from below.

FIG. 1 is a perspective view showing an insertion type earphone 10 according to the embodiment of the invention, FIG. 2 is a sectional side view showing the insertion type earphone 10 in FIG. 1, and FIG. 3 is a fragmentary sectional view showing a backward end part of the insertion type earphone 10 in FIG. 1 as seen from below.

As shown in these drawings, the insertion type earphone 10 according to the embodiment includes a receiver unit 12 and an ear chip 14. The receiver unit 12 has a sound conduit 16 at its forward end (a rightward end in FIG. 2), and the ear chip 14 is fitted to this sound conduit 16. This insertion type earphone 10 is adapted to be used in a state where the ear chip 14 is inserted into an external auditory canal.

The receiver unit 12 includes a receiver body 18, a housing 20 which houses this receiver body 18, a cord 22 connected to the receiver body 18, and a cord protector 34 for protecting the cord 22.

The receiver body 18 is formed of an electromagnetic receiver of a balanced armature type which has a substantially rectangular parallelepiped outer shape, and provided with a sound emitting hole 18*a* at a lower end of a forward end face thereof, and a terminal 18*b* on an upper face thereof in the vicinity of its backward end. This receiver body 18 is so adapted as to emit sound waves from the sound emitting hole

18*a*, according to a signal current which is inputted from the terminal 18*b* through the cord 22.

The housing 20 includes a frame 24 into which the receiver body 18 is inserted and fixed, a casing 26 which is fitted over the frame 24 from the back in a state where it contains a terminal end of the cord 22, and an exterior member 28 which covers the frame 24 and the casing 26 in a tubular shape.

The cord 22 includes conducting wires 22*a* of two poles which are respectively formed of fine conducting wires twisted together, and a cord sheath 22*b* for protecting and insulating exteriors of the conducting wires 22*a*. The conducting wires 22*a* are copper wires formed of copper or the like. The cord sheath 22*b* is formed of PVC (polyvinyl chloride), for example, having Shore hardness of about A70.

The frame 24 is an injection molded product which has been molded out of polycarbonate resin or the like, and has a receiver body inserting portion 24A which forms an insertion space 24Aa into which a forward part of the receiver body 18 is inserted from the back, a block engaging portion 24B which is extended backward from this receiver body inserting portion 24A and adapted to be engaged with the casing 26, a pair of elastic locking pieces 24C which are formed in a shape of cut-out in both left and right side parts of this block engaging portion 24B and adapted to be elastically engaged with the backward end of the receiver body 18, which is inserted in the receiver body inserting portion 24A, from both the left and right sides, and an outer cylindrical portion 24D which is extended, in a cylindrical shape, forwardly from a forward end face 24Ab of the receiver body inserting portion 24A.

The casing 26 is an injection molded product which has been molded out of resin having Shore hardness of about D85 (Rockwell hardness R110), such as ABS resin, and formed in a substantially c-shape in a side view so as to correspond to a shape of the block engaging portion 24B of the frame 24. A projected portion 26*b* is formed at a backward end of the casing 26, and an annular groove 26*a* is formed in the vicinity of the projected portion 26*b*. The cord 22 is inserted into the casing 26 through the insertion hole 36 which is formed at a lower end area of the annular groove 26*a*, and the terminal end of the cord 22 is connected to the terminal 18*b* of the receiver body 18 through a circuit board (not shown). The cord 22 which has been housed in the casing 26 is provided with a bossing-like knot at a position close to the terminal end thereof, and this knot is adapted to be engaged with the casing 26 when the cord 22 is pulled, thereby to resist against a tensile force. Moreover, the cord protector 34 is fitted into the annular groove 26*a*, whereby the cord protector 34 is clamped between the projected portion 26*b* and the cord 22 at a lower side of the receiver unit 12, and clamped between the projected portion 26*b* and the exterior member 28 at an upper side of the receiver unit 12.

It is to be noted that Shore hardness D is generally employed to represent hardness of plastics, and Shore hardness A is generally employed to represent hardness of elastomers. Shore hardness A100 is the hardness substantially corresponding to Shore hardness D45.

The exterior member 28 is formed of soft material such as silicone rubber having Shore hardness of about A30, and has been elastically deformed to some extent in a state where it covers the frame 24 and the casing 26. Specifically, this exterior member 28 is formed in a cylindrical shape by itself, and provided with annular flange portions 28*a*, 28*b* at both ends in an axial direction thereof which are respectively formed so as to protrude radially inwardly. This exterior member 28 is fitted over the frame 24 and the casing 26 from the back side while one of the annular flange portions 28*a* is spread. In a completely fitted state, the annular flange portion 28*a* at a forward end is engaged with a forward end face 24Ab of the receiver body inserting portion 24A of the frame 24, and the annular flange portion 28*b* at a backward end is engaged with the annular groove 26*a* of the casing 26. However, in a lower end area of the annular groove 26*a*, a part of the annular flange portion 28*b* is engaged in a forwardly deformed state so as to divert the cord 22. In this manner, contact between the cord 22 and the casing 26 in a forward area of the cord 22 will be prevented.

The outer cylindrical portion 24D of the frame 24 is provided, at its forward end part, with an annular flange portion 24Da which protrudes radially outwardly. An inner space of this outer cylindrical portion 24D is communicated with the insertion space 24Aa of the receiver body inserting portion 24A. An inner cylindrical member 30 is inserted into this inner space of the outer cylindrical portion 24D from a front side, whereby the above described sound conduit 16 is formed by these outer cylindrical portion 24D and the inner cylindrical member 30.

The inner cylindrical member 30 is an injection molded product which has been molded out of ABC resin, for example, and includes a cylindrical portion 30A and a flange portion 30B which is formed at a forward end of this cylindrical portion 30A so as to protrude radially outwardly. A forward end of a through hole 30*a* which is formed in a center part of the inner cylindrical member 30 is defined as a filter containing portion 30*b* having a larger diameter. An outer diameter of the cylindrical portion 30A at a position close to the forward end thereof is set substantially at the same value as an inner diameter of the outer cylindrical portion 24D, while the outer diameter of the cylindrical portion 30A backward of that position is set to be somewhat smaller than the inner diameter of the outer cylindrical portion 24D. On the other hand, the flange portion 30B is provided with a cut-out in a lower end part thereof, and an upper end part thereof is horizontally chamfered.

On occasion where the inner cylindrical member 30 is inserted into the outer cylindrical portion 24D, positioning with respect to each other in an axial direction will be effected by contacting the flange portion 30B with the forward end face of the outer cylindrical portion 24D, and positioning in a direction around the axis will be effected by engaging the cut-out of the flange portion 30B with a protrusion of the outer cylindrical portion 24D. The inner cylindrical member 30 is slidably engaged with the outer cylindrical portion 24D, at the position close to the forward end of the cylindrical portion 30A.

By inserting this inner cylindrical member 30 into the outer cylindrical portion 24D, a sound passage 16*a* of the sound conduit 16 is formed. This sound passage 16*a* is defined by the through hole 30*a* of the inner cylindrical member 30 and the inner space of the outer cylindrical portion 24D which is slightly exposed backward of the through hole 30*a*.

A disc-shaped acoustic filter 32 formed of non-woven fabric or the like is fixed to the filter containing portion 30*b* of the inner cylindrical member 30 by bonding, pasting with a double-faced tape or so.

The ear chip 14 is formed of soft material such as silicone rubber, and hardness of the material is set to be A=30 to 60 (45, for example) by Shore hardness. The ear chip 14 includes a tubular portion 14A, and a first and a second annular flange portions 14B, 14C. A wall thickness t1 of the first annular flange portion 14B is set to be t1=0.3 to 0.6 mm (0.5 mm, for example), and a wall thickness t2 of the second annular flange portion 14C except its inner peripheral end area is also set to be t2=0.3 to 0.6 mm (0.5 mm, for example). An outer diameter of the first annular flange portion 14B is set to be about ϕ10 mm, and an outer diameter of the second annular flange portion 14C is set to be about ϕ12 mm.

In the tubular portion 14A, a sound passage 14*a* which is communicated with the sound passage 16*a* will be formed by fixing the tubular portion 14A to the sound conduit 16. The first annular flange portion 14B is so formed as to spread in a substantially parabolic shape from a tip end of the tubular portion 14A toward a base end thereof. On the other hand, the second annular flange portion 14C is so formed as to spread in a substantially parabolic shape from an intermediate position of the tubular portion 14A toward the base end thereof.

Although the first annular flange portion 14B is formed to have substantially the same wall thickness from its inner peripheral end to its outer peripheral end, the second annular flange portion 14C is formed to have a large wall thickness at its inner peripheral end, and substantially the same wall thickness in the other areas thereof. The outer diameter of the first annular flange portion 14B is set at a smaller value than the outer diameter of the second annular flange portion 14C. Moreover, the first annular flange portion 14B is formed in a substantially semi-doughnut shape at a position close to the inner peripheral end thereof.

Figure 4:
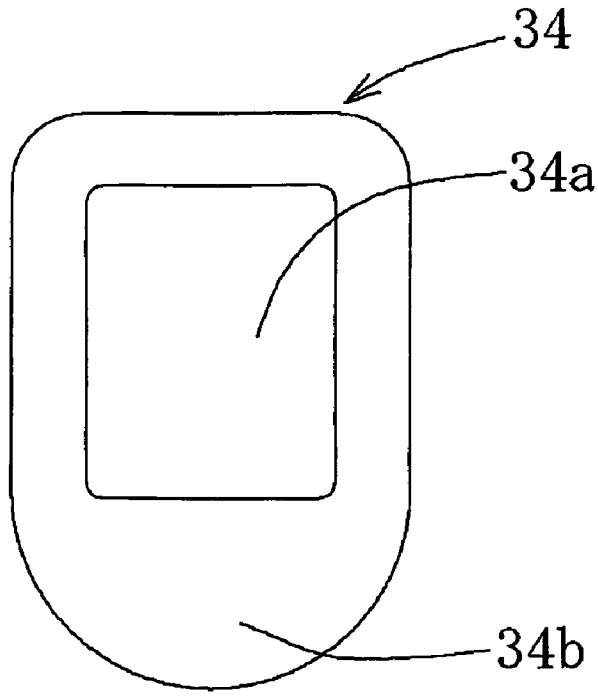
FIG. 4 is a view showing a protective member according to the embodiment of the invention.

The cord protector 34 is a plate-like member having a substantially rectangular shape of which one side is formed in a semicircular shape, as shown in FIG. 4, and includes an engaging portion 34*a* and a semicircular portion 34*b*. The cord protector 34 is formed of soft material such as urethane rubber having Shore hardness of about A90, and its wall thickness t3 is set to be t3=0.3 to 0.6 mm (0.5 mm, for example). Consequently, the cord protector 34 is softer than the casing 26 (Shore hardness D85) and harder than the cord sheath 22*b* (Shore hardness A70). Particularly, material having Shore hardness below A100 would be within a range of hardness of elastomer and suitable for the cord protector 34. This cord protector 34 is arranged along the cord 22, and so configured that the semicircular portion 34*b* may be contacted with the cord 22 when a force backward of the casing 26 is applied to the cord 22, thereby to prevent interference between the cord 22 and an edge of the projected portion 26*b* of the casing 26. The cord protector 34 has elasticity in a direction of fitting the cord protector 34 (in a back and forth direction of the casing 26) so that it may be flexed on such an occasion. Moreover, the cord protector 34 is so configured as to restrict backward movement of the cord 22 in the vicinity of the insertion hole 36 of the casing 26, and therefore, concentration of stress on the conducting wires 22*a* inside the cord 22 in the vicinity of the insertion hole 36 of the casing 26 can be reduced.

The engaging portion 34*a* is formed as a through hole in the cord protector 34 and has a size corresponding to the annular groove 26*a* of the casing 26. The cord protector 34 is fixed to the casing 26, by engaging the engaging portion 34*a* with the annular groove 26*a* through the projected portion 26*b* of the casing 26. The semicircular portion 34*b* of the cord protector 34 is extended downwardly in FIG. 4, and arranged so as to be positioned between the projected portion 26*b* and the cord 22. As described above, because the cord protector 34 is attached to the casing 26 by engaging the engaging portion 34*a* with the annular groove 26*a* through the projected portion 26*b* of the casing 26, it is possible to attach the cord protector 34 after the insertion type earphone 10 has been assembled. This means that there is no need of providing a protective member on the cord 22 in advance, or applying a particular work to the casing 26 in order to provide the protective member thereon, and accordingly, it is possible to attach the protective member easily and at a low cost.

As fully described hereinabove, because the insertion type earphone 10 according to this embodiment has the cord protector 34 for the purpose of preventing a breakage of the cord 22, concentration of stress on the conducting wires 22*a* in the cord 22 due to a crook of the cord 22 can be avoided, and as a result, breakage of the conducting wires can be prevented.

Moreover, in the earphone of the type that the cord 22 is extended from the backward lower part of the casing 26, due to the fact that the cord protector 34 is the plate-like member which is adapted to be attached through the projected portion 26*b* in the back of the casing 26 and has such elasticity in the back and forth direction of the casing 26 as to be flexed in response to an outer force backward of the casing 26 applied to the cord 22, repeated crooks of the cord 22 in the vicinity of the insertion hole 36 of the casing 26 will be eliminated, and thus, breakages of the conducting wires 22*a* inside the cord 22 can be reliably prevented.

Further, because the cord protector 34 is formed of the resin which is softer in hardness than the casing 26 and harder than the cord sheath 22*b* of the cord 22, the cord protector 34 will not be broken due to friction with the cord sheath 22*b*, and protecting performance can be exerted for a long term. Still further, because the cord 22 is kept in contact with the semicircular portion 34*b* of the cord protector 34, damage of the cord 22 can be prevented.

Particularly, it is desirable that the cord protector 34 has Shore hardness below A100, whereby a breakage of the cord 22 can be prevented, and a long life protective member free from a breakage of the cord protector 34 can be realized.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An earphone comprising:

a fitting portion to be fitted to an inlet of an external auditory canal;

a casing which supports the fitting portion, the fitting portion being provided forward of the casing in a direction of inserting it into the external auditory canal; and a cable which is extended from the casing to an external apparatus, wherein the casing is provided with a protective member which is arranged along the cable and formed of a plate-like member, the cable is extended from a backward lower part of the casing, the protective member is a plate-like member having elasticity in a back and forth direction of the casing, and attached to a back of the casing and pressed against the cable from backside.

2. The earphone according to claim 1, wherein at least a part of the casing forward of a position where the cable is extended is covered with an exterior member, the exterior member being softer in hardness than the casing, and the exterior member is configured to prevent contact between the cable and the casing in a forward area of the cable.

3. The earphone according to claim 1, wherein the protective member is formed of resin which is softer in hardness than the casing and harder than a sheath of the cable.

4. The earphone according to claim 2, wherein the protective member is formed of resin which is softer in hardness than the casing and harder than a sheath of the cable.

5. The earphone according to claim 1, wherein the protective member has Shore hardness below A100.

6. The earphone according to claim 2, wherein the protective member has Shore hardness below A100.

7. The earphone according to claim 3, wherein the protective member has Shore hardness below A100.

8. The earphone according to claim 4, wherein the protective member has Shore hardness below A100.

* * * * *